United States Patent [19]

Kishino et al.

[11] 4,303,917

[45] Dec. 1, 1981

[54] FLUORESCENT DISPLAY DEVICE

[75] Inventors: Takao Kishino; Fumio Ichihara; Nobuo Yamaguchi, all of Mobara, Japan

[73] Assignee: Futaba Denshi Kogyo Kabushiki Kaisha, Mobara, Japan

[21] Appl. No.: 971,568

[22] Filed: Dec. 20, 1978

[30] Foreign Application Priority Data

Dec. 28, 1977 [JP] Japan ..... 52-157322

[51] Int. Cl.[3] ..... H01J 17/48

[52] U.S. Cl. ..... 340/772; 313/496; 313/519; 315/169.4; 340/758

[58] Field of Search ..... 340/753, 802, 754, 772; 313/519, 496; 315/169.4

[56] References Cited

U.S. PATENT DOCUMENTS 3,328,790 6/1967 Rhodes ..... 340/753
3,922,666 11/1975 Inami et al. ..... 340/802 X
4,149,147 4/1979 Kishino ..... 340/802 X
4,156,239 5/1979 Hirano et al. ..... 313/519 X

*Primary Examiner*—David L. Trafton
*Attorney, Agent, or Firm*—Oblon, Fisher, Spivak, McClelland & Maier

[57] ABSTRACT

A fluorescent display device comprising a display tube section having a plurality of phosphur-coated anodes arranged in the form of a matrix and electrically connected together on a row-by-row basis, the anodes being grouped into a plurality of groups each having a plurality of anodes, primary control electrodes provided opposite to the anodes, one for each group, secondary control electrodes provided between the primary control electrodes and the anodes, one for each column, the groups being grouped into a plurality of blocks each containing at least two groups, and the secondary control electrodes being provided so that those disposed opposite to the corresponding columns of the blocks are electrically connected together by control-electrode wires.

8 Claims, 5 Drawing Figures

FLUORESCENT DISPLAY DEVICE

BACKGROUND OF THE INVENTION

1. Field of the Invention

The present invention relates to a fluorescent display device in which phosphor-coated anodes arranged in the form of matrix and disposed in groups are adapted to selectively luminesce so as to visually display characters, graphic forms and the like.

2. Description of the Prior Art

The fluorescent display device, in which thermions emitted from a heated filamentary cathode are made to impinge selectively on phosphor-coated anodes so as to visually display characters, graphic forms and the like, is widely used as the display device of electronic equipment or the like, because of its fine color of light emitted, capability of being driven on a low voltage, low power consumption, etc.

Heretofore, fluorescent display devices have been mainly used as numeric-character display devices. In the numeric-character display devices of this type, each pattern display section for one digit is formed of phosphor-coated segment anodes arranged in the shape of the digit 8 and thermions emitted from the cathode are made to impinge selectively on these segment anodes so as to visually display the numerals 0 to 9 as necessary.

The fluorescent display devices of this type have recently become increasingly diversified in the mode of display, as the number of their applications increases. The following examples are of the fluorescent display devices of the matrix type recently developed and put into practical use:

In one example, each pattern display section for one digit is made up of a group of phosphor-coated dot-shaped or rectangular anodes arranged in the form of matrix and these anodes are selectively bombarded with electrons so as to visually display characters and numeric characters. In another example, equally-spaced anodes are arranged in the form of matrix throughout the entire display surface so that graphic forms can be displayed. In still another example, a scanning means is provided to continuously move visually-displayed characters and graphic forms in a predetermined direction so as to improve the effect of display.

An example of the fluorescent display device of the matrix type is shown in FIG. 1, in which the arrangement of the groups of anodes and that of control electrodes are given. In FIG. 1, reference numeral 1 designates phosphor-coated anodes arranged on a substrate (not shown) in the form of matrix. The anodes 1 are electrically connected together by anode wires 2 on a row-by-row basis. In other words, the anodes 1 on the same row of the matrix are electrically connected together by each anode wire 2. Control electrodes 3, or grids, are disposed above the anodes 1 on a column-by-column basis. In other words, each of the control electrodes 3 is disposed above the anodes 1 disposed on each column of the matrix. The control electrodes 3 is in the form of, for instance, mesh-shape so that light emitted from the anodes 1 can be clearly seen, being connected to external terminals 4 respectively.

Thus, if an anode signal is given selectively to the anode wires 2 and a control signal is given selectively to the control electrodes 3, electrons emitted from the cathode (not shown) impinge on the anodes 2 positioned at points where the anode wires 2 to which the anode signal is selectively given intersect with the control electrodes 3 to which the control signal is selectively given, and thereby characters or graphic forms are visually displayed.

In addition, characters and graphic forms displayed can be continuously moved by the following method:

The control electrodes 3 are scanned successively at regular intervals. According to this scanning of the control electrodes 3, the anode wires 2 to which the anode signal is given are cyclically changed. In this manner, the continuously-moving display can be realized.

However, the conventional fluorescent display device of the matrix type shown in FIG. 1 has the following problems and disadvantages:

In order to display characters, graphic forms and the like in a more natural and accurate form, it is required to increase the number of anodes 1. The increase in the number of the anodes 1 results in the increase in the number of the anode wires 2 and that of the external terminals 4 for giving the control signal to the control electrodes 3. In other words, the number of external terminals for giving drive signals to various electrodes becomes extremely large. As a result, the production process becomes complicated and the assembly accuracy required becomes high. For instance, if the matrix of anodes 1 consists of m rows and n columns, the number of external terminals required is equal to "m+n+2" including the number of external terminals for the cathode. Therefore, it is required to lead this number of external terminals outside of the periphery of the substrate.

In addition, the unselected control electrodes 3 (i.e., the control electrodes 3 to which the control signal is not given) are usually kept at a negative potential lower than the cathode potential, and therefore negative electric fields formed by these unselected control grids 3 have influence on the passage of electrons impinging on the selected anodes 1. For instance, if an unselected control electrode 3 is adjacent to a luminescing anode 1, a region on which electrons cannot impinge, or a display defect, will occur at the edge of the luminescing anode 1. Especially, when the anodes 1 are arranged at close intervals so as to perform accurate display, the above-mentioned display defects are liable to occur, resulting in the deterioration of the display quality.

SUMMARY OF THE INVENTION

Therefore, the present invention is intended to eliminate the above-mentioned disadvantages of the prior art.

It is an object of the present invention to provide a fluorescent display device which is extremely small in the number of external terminals required.

It is another object of the present invention to provide a fluorescent display device which can surely prevent the occurrence of display defects thereby giving high-quality display.

It is still another object of the present invention to provide a fluorescent display device which can be produced and assembled by extremely simplified operations.

According to one aspect of the present invention, there is provided a fluorescent display device comprising a display tube section, the display tube section having a plurality of phosphor-coated anodes arranged in the form of a matrix having rows and columns and electrically connected together on a row-by-row basis.

These anodes are grouped into a plurality of groups each having a plurality of the anodes, one for each group, primary control electrodes separately provided opposite to the anodes and between the primary control electrodes and the anodes, one for each column. These groups are grouped into a plurality of blocks each containing at least two groups, and control-electrode wires for electrically connecting the secondary control electrodes so that those disposed opposite to the corresponding columns of the blocks are electrically connected together.

According to another aspect of the present invention, the fluorescent display device further comprises a control circuit for successively scanning the primary control electrodes and giving a control signal to the selected primary control electrodes and also to those adjacent to the selected ones.

DETAILED DESCRIPTION OF THE PREFERRED EMBODIMENTS

Now, a preferred embodiment of the present invention will be hereinafter described with reference to the accompanying drawings.

Figure 2:
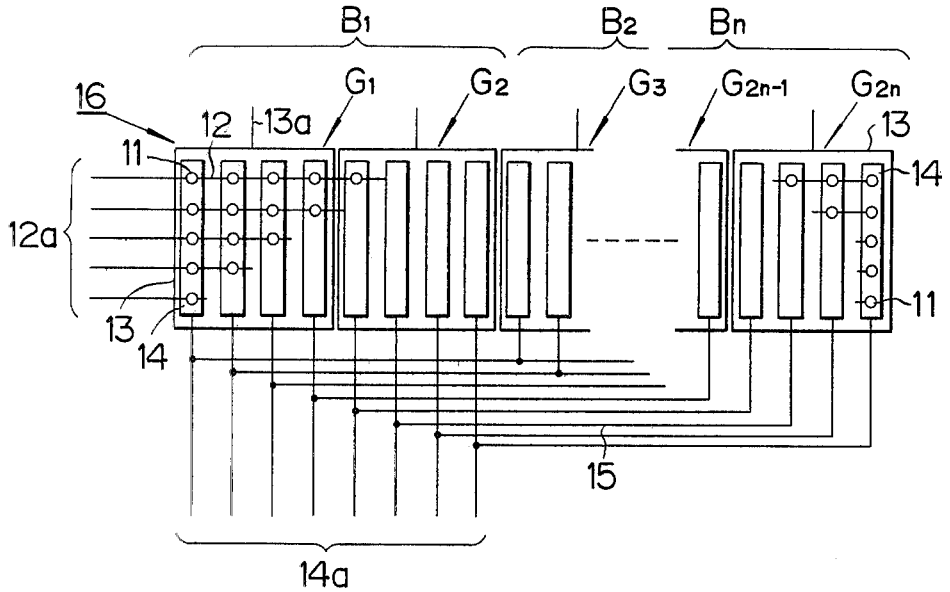
FIG. 2 is an arrangement drawing of the essential part of a fluorescent display device according to a preferred embodiment of the present invention.

Reference is now made to FIG. 2, which is a schematical arrangement drawing of a fluorescent device according to a preferred embodiment of the present invention, showing anodes, control electrodes and their connections.

In FIG. 2, reference numeral 11 designates phosphor-coated anodes arranged on an insulating substrate (not shown) in the form of a matrix having rows and columns. Reference numeral 12 designates anode wires for electrically connecting the anodes 11 together on a row-by-row basis. In other words, the anodes 11 arranged on each row of the matrix is connected together by the anode wires 12. The anodes 11 are grouped into a plurality of groups G ($G_1, G_2, \ldots, G_{2n}$) each containing a plurality of the anodes 11. Reference numeral 13 designates primary control electrodes provided opposite to the anodes 11, one for each group G. The control electrode 13 is in the form of, for instance, a mesh-shaped grid. Reference numeral 14 designates secondary control electrodes provided between the anodes 11 and the primary control electrodes 13 and opposite to the anodes 11, one for each column of the matrix. The secondary control electrode 14 is in the form of, for instance, a mesh-shaped grid. The above-mentioned groups G are grouped into blocks B ($B_1, B_2, \ldots B_n$) each containing at least two groups. In addition, the secondary control electrodes 14 are so provided that those disposed opposite to the corresponding columns of the blocks B are electrically connected together by control-electrode wires 15.

At least one filamentary cathode (not shown) is provided above and opposite to the primary control electrodes 13. The above-mentioned control electrodes, anodes and cathode are accommodated in a high-vacuum package having a display window section. Thus, a display tube section 16 is formed.

Figure 1:
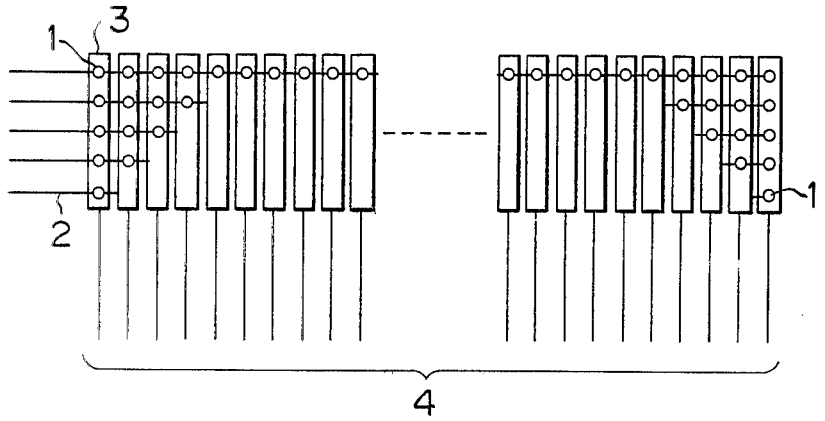
FIG. 1 (PRIOR ART)
FIG. 1 is an arrangement drawing of the essential part of a conventional fluorescent display device of the matrix type.

In this example, the number of external terminals required to be led out of the package of the display tube section 16 is equal to the total of the number of external terminals 12*a* extending from the anode wires 12 corresponding to the rows of the matrix respectively, the number of external terminals 13*a* led out of the primary control electrodes 13 corresponding to the groups G respectively, and the number of external terminals 14*a* extending from the control electrode wires 15 by which those of the secondary electrodes disposed opposite to the corresponding columns of the blocks B are electrically connected together respectively. The external terminals 13*a* for supplying control signals to the primary control electrodes 13 are not required in the case of the conventional device shown in FIG. 1. However, in the case of the device according to the present invention, the number of the external terminals 14*a* for supplying control signals to the secondary control electrodes is remarkably small. Therefore, the device of the present invention is extremely smaller in the total number of external terminals than the conventional device. As a result, its assemblying operations can be made very easily and in a short period of time.

Figure 3:
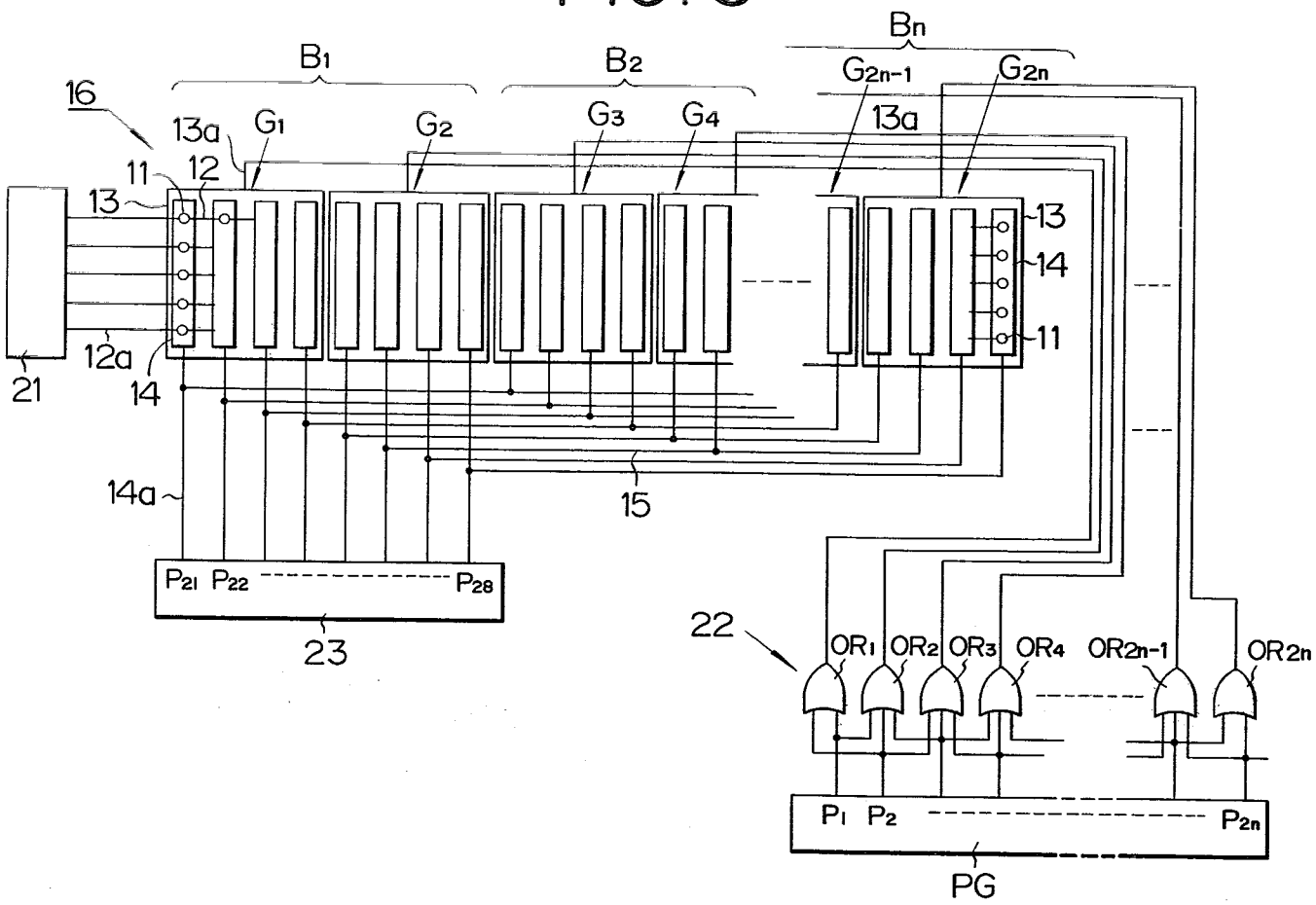
FIG. 3 is a schematical arrangement drawing of the device shown in FIG. 2, including the drive section thereof.

Hereinafter described with reference to FIG. 3 will be the entire configuration of the fluorescent display device of the present invention including a drive section for driving the display tube section 16 shown in FIG. 2. In FIGS. 2 and 3, like reference characters designate corresponding parts.

Reference numeral 21 designates an anode-signal generating circuit for giving an anode signal kept at a positive potential with respect to the cathode to each row of the anodes through each of the external terminals 12*a*. Reference numeral designates a primary control circuit consisting of a pulse generator PG for generating a pulse signal at predetermined intervals on its output terminals successively and cyclically and multi-input "or" circuits OR ($OR_1, OR_2, \ldots, OR_{2n}$) for giving control signals kept at a positive potential with respect to the cathode to the primary control electrodes 13 through the external terminals 13*a* of the display tube section 16 in response to the pulse signal outputted from the pulse generator PG. Reference numeral 23 designates a secondary control circuit for giving a control signal kept at a positive potential with respect to the cathode to the secondary control electrodes 14 through the external terminals 14*a* successively and cyclically.

Figure 4:
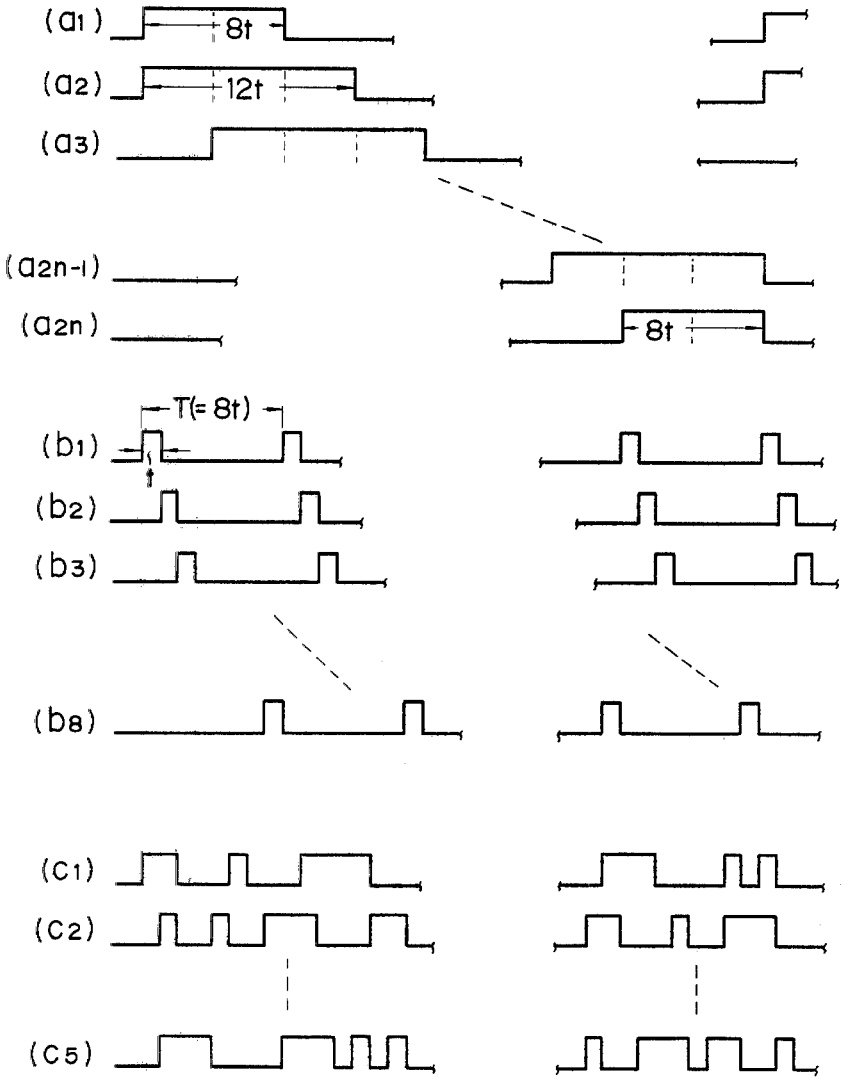
FIG. 4 is a timing diagram of assistance in explaining the operation of the preferred embodiment shown in FIG. 2.

With the above construction, the fluorescent display device of the present invention may be operated as follows:

In the case of the display tube section 16 shown in FIGS. 2 and 3, each group G has four columns of anodes 11, and each block B consists of two groups G, i.e., eight columns of anodes 11. Accordingly, from its eight output terminals $P_{21}, \ldots, P_{28}$, the secondary control circuit 23 outputs successively and selectively pulse signals having a pulse width of "t" and a period of "T (=8t)" as shown in FIGS. 4($b_1$) to ($b_8$), respectively. Thus, the secondary control electrodes 14 disposed at the corresponding positions of the respective blocks B are successively scanned with a duty factor of $\frac{1}{8}$.

In the primary control circuit 22 for giving the control signal to the control electrodes 13, pulse signals having a pulse width of 4t corresponding to the period during which the secondary control electrodes 14 for each group are scanned appear at the output terminals $P_1, \ldots, P_{2n}$ of the pulse generator PG successively and selectively, being fed to the input terminals of the "or" circuits OR.

Fed to each of the "or" circuits OR is the output from the corresponding output terminal on the pulse generator PG and also the output or outputs from the output terminal or terminals adjacent to the above-mentioned corresponding terminal. The "or" circuits OR output control signals shown in FIGS. 4($a_1$) to ($a_{2n}$), which are successively given to the respective primary control electrodes 13 through the external terminals 13*a*.

More particularly, the primary control electrodes 13 disposed above the groups $G_1$ and $G_{2n}$ positioned at the longitudinal ends of the display tube section 16 are given pulse signals having a pulse width of "8t" as shown in FIGS. 4($a_1$) and ($a_{2n}$), respectively, and the other primary control electrodes 13 are given pulse signals having a pulse width of "12t" as shown in FIGS. 4($a_2$) to ($a_{2n-1}$), respectively.

For instance, when the primary control electrode 13 corresponding to the group $G_1$ is selected by the primary control circuit 22 as shown in FIG. 4($a_1$), the primary control electrode 13 corresponding to the group $G_2$ adjacent to the group $G_1$ is also given the same control signal thereby being kept at a positive potential.

When the primary control electrode 13 corresponding to the group $G_2$ is selected, the control electrodes 13 corresponding to the groups $G_1$ and $G_3$ adjacent to the group $G_2$ are also given the same control signal. Thus, when a particular primary control electrode 13 is selected, the primary control electrode or electrodes 13 adjacent to the selected primary control electrode 13 are given the same control signal at the same time, being kept at a positive potential.

Meanwhile, the anode-signal generating circuit 21 gives anode signals to the anodes 11 on a row-by-row basis according to the pattern to be displayed as shown, for instance, in FIGS. 4($C_1$) to ($C_5$).

Thus, in a group G selected by the primary control electrode 13, electrons emitted from the cathode (not shown) impinge on an anode 11 positioned at the point where a row of anodes being given the anode signal intersects with a column of anodes being scanned by the secondary control electrode 14. In this manner, a predetermined pattern is displayed.

As mentioned above, the primary control electrode or electrodes 13 adjacent to a selected control electrode 13 are also given the control electrode thereby being kept at a positive potential. Therefore, for instance, even when the secondary control electrode 14 corresponding to the column at the end of each group G is scanned and thereby the anode 11 on this column is made to luminesce, the passage of electrons impinging on the anode 11 to which the anode signal is given is not adversely influenced because the adjacent control electrode 13 is also kept at a positive potential. As a result, electrons can impinge on the entire surface of the selected anode 11 uniformly.

According to the present invention, therefore, troubles such as the occurrence of display defects can be eliminated and, as a result, the brightness of each luminescing anode 11 becomes uniform and thereby a high-quality display is ensured.

Figure 5:
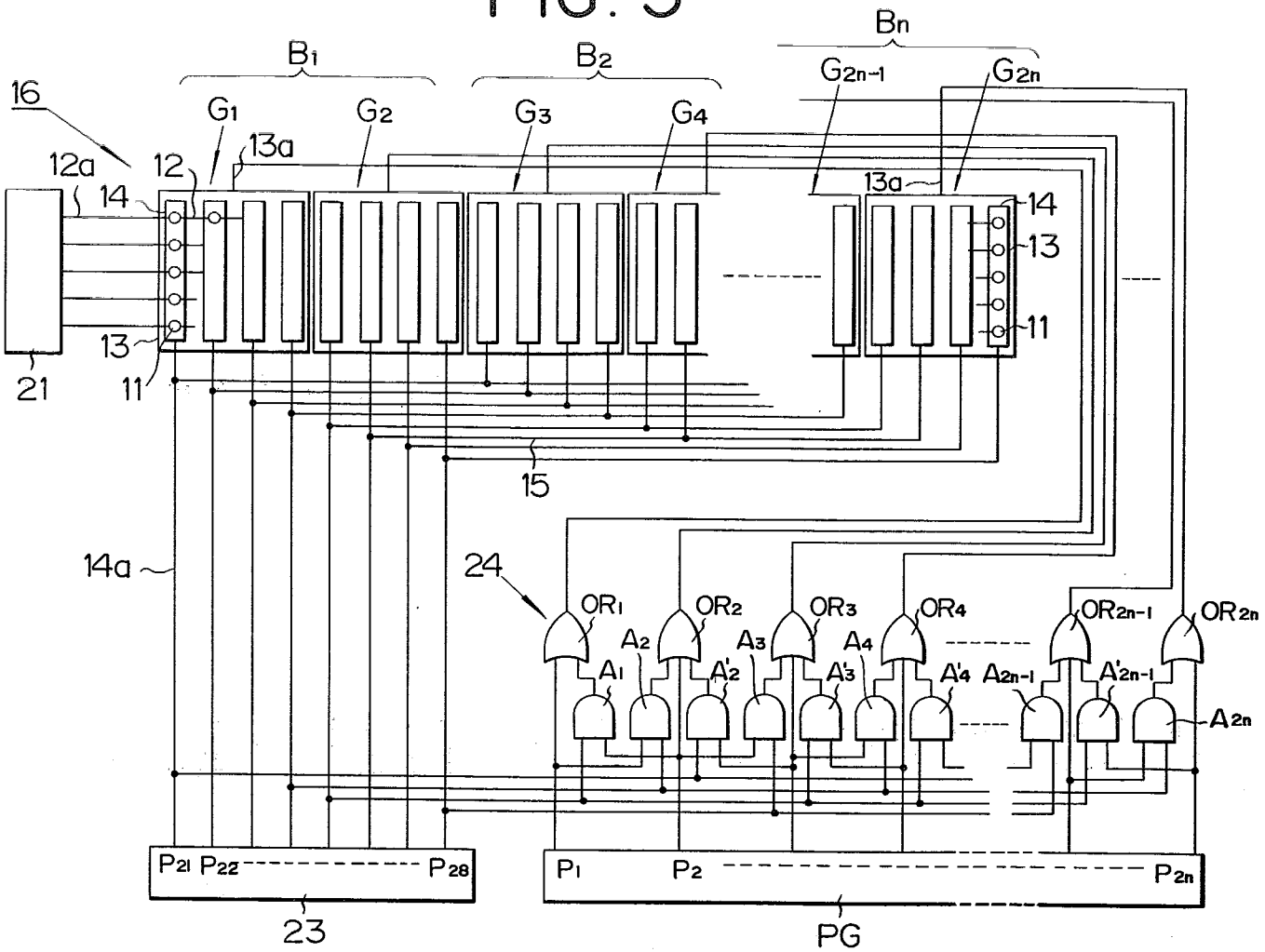
FIG. 5 is a schematical arrangement drawing of a fluorescent display device according to another preferred embodiment of the present invention.

In the above-mentioned preferred embodiment shown in FIG. 3; when a particular primary control electrode 13 is selected and given the control signal, the primary control electrode or electrodes 13 adjacent to the selected control electrode 13 are at all times given the same control signal. However, the possibility of the occurrence of display defects exists only when the anodes 11 positioned at the end columns of each group G are made to luninesce. FIG. 5 shows another preferred embodiment of the present invention proposed in consideration of the above-mentioned fact.

In the preferred embodiment shown in FIG. 5, the device is so made that, only when the anodes 11 positioned at an end column of each group G are made to luminesce, the primary control electrode 13 adjacent to this end row is given the control signal. Thus, the device can prevent ineffective current from flowing into the primary electrode 13 thereby decreasing power consumption.

In the preferred embodiment shown in FIG. 5, a primary control circuit 24 for giving the control signal to the primary control electrode 13 has the following configuration:

The pulse generator PG generates pulse signals having a predetermined pulse width from its output terminals $P_1, \ldots, P_{2n}$ successively and cyclically, as in the case of the first preferred embodiment. These outputs are fed to the respective "or" circuits OR. "And" circuits $A(A_1, A_2, \ldots, A'_2, A'_3, \ldots, A'_{n-1})$ are provided, the input sides of which are connected to the outputs of the pulse generator PG to be fed to the adjacent "or" circuits OR and also connected to the outputs of the secondary control circuits 23 corresponding to the secondary control electrodes 14 positioned at the ends of the groups G adjacent to the primary control electrodes 13 to which the outputs of the "or" circuits OR of interest are fed.

For instance, when the primary control electrode 13 for the group $G_1$ is selected by the primary control circuit 24 and the secondary control electrodes 14 in this group $G_1$ are successively scanned by the output of the secondary control circuit 23 and, in addition, the secondary control electrode 14 positioned at the end of the group $G_1$ adjacent to the group $G_2$ is given the control signal, an "and" operation is performed in the "and" circuit $A_2$. Thus, the primary control electrode 13 opposite to the group $G_2$ is given the control signal through the "or" circuit $OR_2$, being kept at a positive potential. As a result, the anodes 11 on the column positioned at the end of the group $G_1$ are bombarded uniformly with electrons from the cathode throughout their entire surfaces. Thus, uniform luminescence with no defect can be obtained at the anodes 11 positioned at the ends of the groups G as well as at the other columns thereof.

When the primary control electrode 13 corresponding to the group $G_2$ is selected by the primary control circuit 24 in the same manner and when the control signal is given to the secondary control electrodes 14 positioned opposite to the columns of anodes 11 arranged at the end positions adjacent to the groups $G_1$ and $G_3$ respectively, the primary control electrodes 13 adjacent to the primary control electrode 13 corresponding to the group $G_2$ are also given the control signal thereby being kept at a positive potential. Thus, the display defects can be prevented.

As mentioned above, in the preferred embodiment of the present invention shown in FIG. 5, the adjacent primary control electrodes 13 are given the control signal only when the anodes 11 positioned at the end columns of the groups G. Thus, ineffective current is prevented from flowing into the primary control electrodes 13 and thereby power consumption is reduced very effectively.

In the above-mentioned preferred embodiments of the present invention, description was made on the fluorescent display devices of the type in which equally-spaced anodes 11 are arranged in the form of a matrix throughout the entire display surface. However, the present invention may be applied also to the conventional multi-digit fluorescent display device in which the pattern display section for each digit is composed of a plurality of anodes and a suitable space is provided between the pattern display sections or digits. In this application, each block B shown in FIG. 2 corresponds to the pattern display section for each digit.

In the above-mentioned preferred embodiments of the present invention, no blanking period is provided in the scanning period of the secondary control electrodes 14. However, a proper blanking period or periods may be provided in order to prevent overlapping of display.

As mentioned above, the fluorescent display device of the present invention has a display tube section having a plurality of phosphor-coated anodes arranged in the form of a matrix and electrically connected together on a row-by-row basis, the anodes being grouped into a plurality of groups each having a plurality of anodes, primary control electrodes provided opposite to the anodes, one for each group, secondary control electrodes separately provided opposite to the anodes and between the primary control electrodes and the anodes, one for each column, the groups being grouped into a plurality of blocks each containing at least two groups, and the secondary control electrodes being provided so that those disposed opposite to the corresponding columns of the blocks are electrically connected together. Therefore, the present invention can remarkably decrease the number of external terminals required to be led out of the display tube section, and can extremely simplify the operations for the production and assembly of the device.

The present invention is especially effective for the production of the fluorescent display device in which the anodes are increased in number and arranged at more close intervals in order to display characters, graphic forms and the like in a natural and accurate form.

According to the present invention, in addition, the fluorescent display device is driven so that, when the anodes positioned at the end column of each group are made to luminesce, the primary control electrode adjacent to the above column is also given the control signal thereby being kept at a positive potential. Thus, the passage of electrons impinging on the anodes is not influenced by an external negative electric field. Accordingly, high-quality uniform display with no defect can be achieved at all the anodes.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A fluorescent display device comprising a display tube section, said display tube section having a plurality of phosphor-coated anodes arranged in the form of a matrix having rows and columns and electrically connected together on a row-by-row basis, said anodes being grouped into a plurality of groups each having a plurality of the anodes, primary control electrodes provided opposite to said anodes, one for each group, secondary control electrodes separately provided opposite to said anodes and between said primary control electrodes and said anodes, one for each column, said groups being grouped into a plurality of blocks each containing at least two groups, and said secondary control electrodes being provided so that those disposed opposite to the corresponding columns of said blocks are electrically connected together by control-electrode wires.

2. The fluorescent display device as set forth in claim 1, further comprising a primary control circuit for successively selecting said primary control electrodes and for selectively giving control signals to the selected primary control electrodes and to the primary control electrodes adjacent to said selected primary control electrodes, and a secondary control circuit for giving control signals to said secondary control electrodes successively and selectively.

3. The fluorescent display device as set forth in claim 1, further comprising a primary control circuit for successively selecting said primary control electrodes and for giving control signals to the selected primary control electrodes and to the primary control electrodes adjacent to the secondary control electrodes positioned opposite to the end columns of the groups corresponding to said selected primary control electrodes, and a secondary control circuit for successively and selectively giving control signals to said secondary control electrodes.

4. The fluorescent display device as set forth in claim 1 wherein said primary electrodes are made of mesh-shaped grids.

5. The fluorescent display device as set forth in claim 2 wherein said primary control circuit includes a pulse generator for generating pulse signals at predetermined intervals and "Or" circuit for giving control signals in response to said pulse signals outputted from said pulse generator.

6. The fluorescent display device as set forth in claim 5 wherein said control signals generated from said "Or" circuit are kept at a positive potential with respect to cathodes to said primary control electrodes.

7. The fluorescent display device as set forth in claim 2 wherein said control signals generated from said secondary control circuit are kept at a positive potential with respect to cathodes to said secondary control electrodes.

8. The fluorescent display device as set forth in claim 3 wherein said primary control circuit includes a pulse generator, "Or" circuit and "And" circuit, input sides of said "And" circuit being connected to outputs of said pulse generator to be fed to adjacent "Or" circuits and connected to outputs of said secondary control circuits corresponding to said secondary control electrodes positioned at ends of groups adjacent to said primary control electrodes.

* * * * *